US005235372A

United States Patent [19]

Blumé

[11] Patent Number: 5,235,372

[45] Date of Patent: Aug. 10, 1993

[54] AUTOMATED DENTAL X-RAY SYSTEM

[76] Inventor: Stephen T. Blumé, 25462 Wagon Wheel Cir., Laguna Hills, Calif. 92653

[21] Appl. No.: 851,468

[22] Filed: Mar. 13, 1992

[51] Int. Cl.[5] ..... G03D 3/08; G03D 3/02

[52] U.S. Cl. ..... 354/323; 354/324

[58] Field of Search ..... 354/323, 324, 331

[56] References Cited

U.S. PATENT DOCUMENTS

| | | | |
|---|---|---|---|
| 2,989,911 | 6/1961 | Winnek | 95/89 |
| 3,000,288 | 9/1961 | Winnek | 95/89 |
| 3,437,030 | 4/1969 | Mastrosimone et al. | 95/93 |
| 3,792,487 | 2/1974 | Peres | 95/99 |
| 3,890,629 | 6/1975 | Huss | 354/299 |
| 4,054,902 | 10/1977 | Rebek | 354/329 |
| 4,097,884 | 6/1978 | Lasky et al. | 354/323 |
| 4,134,665 | 1/1979 | Wada et al. | 354/324 X |
| 4,217,054 | 8/1980 | Gacki et al. | 366/150 |

*Primary Examiner*—D. Rutledge

*Attorney, Agent, or Firm*—Stetina and Brunda

[57] ABSTRACT

An automated dental x-ray system comprising a housing having a pair of reservoirs capable of storing relatively large quantities of developer and fixative agents therein. The developer and fixative reservoirs communicate via respective valves to a reaction chamber which includes one or more water fillers connected to an incoming water source. The reaction chamber includes a cover plate selectively movable between raised and lowered positions. A dryer cabinet is provided above the reaction chamber with an electric heat fan mounted thereto. Additionally, an x-ray cassette is provided which is mountable to the under surface of the cover plate and adapted to receive conventional x-ray film in the order and orientation of exposure. A large film rack for holding panographic and medical x-ray film during processing and a wall attachment to hold the large film rack and cassette while x-rays are being exposed is disclosed.

9 Claims, 3 Drawing Sheets

Fig. 7
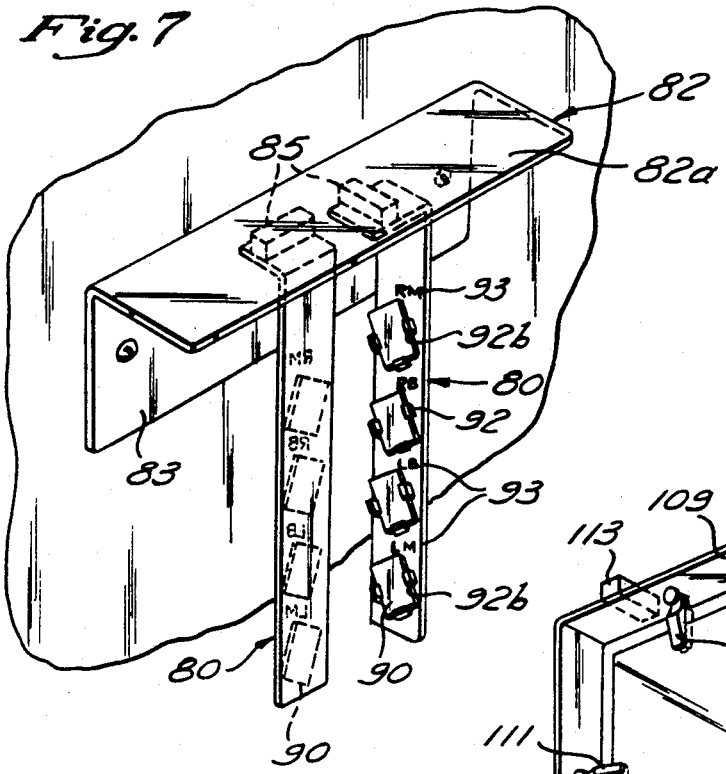
Fig. 8
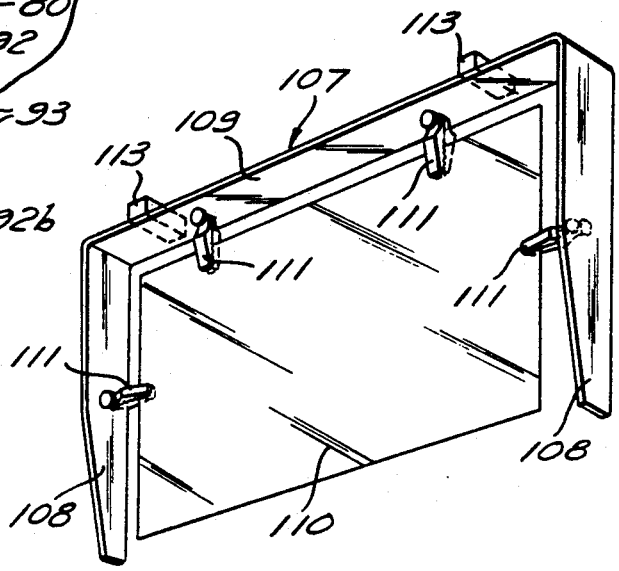
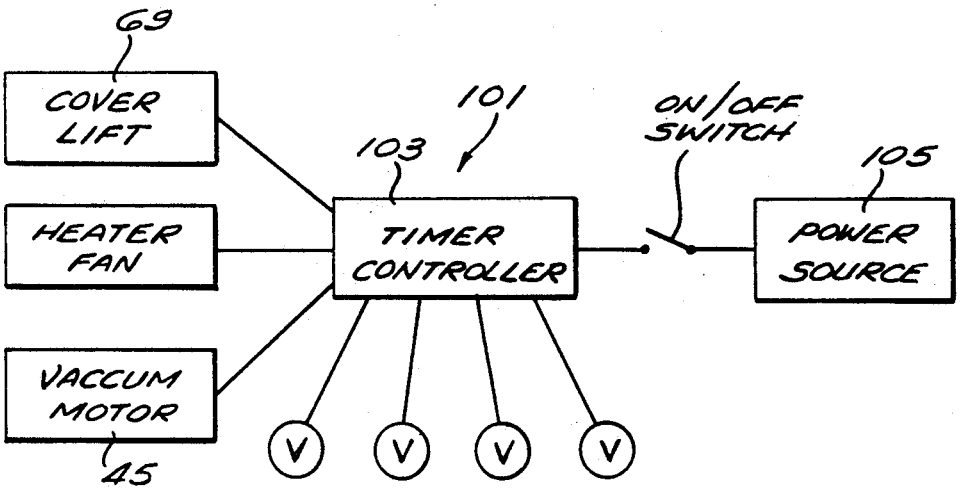
Fig. 9

AUTOMATED DENTAL X-RAY SYSTEM

FIELD OF THE INVENTION

The present invention relates generally to film developing equipment, and more particularly to a cassette film holder, a large film holder, and an automated dental x-ray film developer wherein the x-ray film is maintained stationary while developer, fixative, and wash solutions are selectively and sequentially applied thereto in a reaction chamber.

BACKGROUND OF THE INVENTION

Currently, dental x-rays are typically developed at the dental office by either a hand or an automated system. In the hand developing systems of the prior art, the x-ray film is placed upon a fixture and sequentially manually dipped into a developer solution reservoir, wash solution reservoir, fixative solution reservoir, wash solution reservoir, and is subsequently air dried. In the prior art automated developing systems, the x-ray film travels via a complicated conveyor system, which is typically formed of a plurality of rollers, through sequential developer, fixative, wash, and drying basins.

Although these prior art systems have proven generally suitable for developing dental x-ray film, such systems possess certain inherent deficiencies which detract from their overall utility. In this respect, the hand developing systems require skilled operators while the automated systems are extremely costly and further require continuous maintenance due to their complicated roller conveyor systems. Further, the automated systems of the prior art oftentimes scratch the x-ray film as it is conveyed sequentially from the developer, fixative, and wash basins thereby damaging and/or destroying the same. Further, problems exist whereby the x-ray films may become inadvertently mixed so that the order, orientation, or identity of the patient will be incorrect, leading to a reat many potentially serious errors in diagnosis.

The present invention is specifically designed to eliminate the above deficiencies of the prior art. In this regard, the present invention comprises an automated x-ray developer system wherein the x-ray film is maintained stationary and developer, fixative, and wash solutions are sequentially presented to the x-ray film. This facilitates high quality development, and correct identity, order, and orientation of the film from mouth to mount.

SUMMARY OF THE INVENTION

In accordance with a preferred embodiment of the present invention there is provided an x-ray cassette which holds the films during manipulation, a large film rack, a wall holder, and an automated dental x-ray film developer comprising a housing defining first and second reservoirs which are capable of storing relatively large quantities of developer and fixative agents therein. Fluidly connected to the first and second reservoirs is at least one vacuum motor. The housing further includes a reaction chamber defining front, back, and side walls, an upper rim, and a lower surface which is sized and configured to receive an x-ray film cassette and/or large film holder therein. In the preferred embodiment, the bottom surfaces of the first and second reservoirs reside on a common plane which is disposed between the lower surface and upper rim of the reaction chamber.

The first and second reservoirs communicate via respective feed lines or conduits to the reaction chamber. Disposed within each of the feed lines is a valve which is operable to selectively place a respective reservoir in fluid communication with the reaction chamber. Preferably, each of the feed lines connecting the reservoirs to the reaction chamber extend between a point adjacent the bottom surface of a respective reservoir to a point adjacent the lower surface of the reaction chamber. The reaction chamber is sized to receive either a bitewing x-ray cassette or a large film holder, such as panographic types. Additionally, fluidly coupled to and extending from the reaction chamber adjacent the lower surface thereof is a drain line which includes a drain valve coupled therein for selectively opening and closing the drain line. The reaction chamber further includes one or more water filler hoses fluidly coupled thereto which are connected to an incoming water source and used to fill the reaction tank with water, thereby rinsing the x-ray film. Also fluidly coupled to the reaction chamber adjacent the upper rim is an overflow line. Above the reaction tank is attached a cabinet or enclosure used for drying the x-ray film.

In the preferred embodiment of the present invention, the housing further comprises a cover member which is selectively attachable to the upper rim of the reaction chamber or to the side of the dryer cabinet. The cover member has an inner surface and an outer surface and is movable between a raised position whereat the cover member is separated from the upper rim and a lowered position whereat the cover member is in abutting contact with the upper rim.

The wall holder of the present invention has a wall plate for mounting on the external portion of the x-ray operatory wall, and an attachment plate which has fasteners analogous to those on the underside of the cover plate of the reaction chamber. The large film holder or rack of the present invention preferably comprises a frame member having two vertical members with clips which will facilitate the holding of the larger film, and a horizontal member which is connected to an attachment device. The attachment device facilitates the holding of the rack to the cover plate of the reaction chamber, and the attachment plate of the wall holder. The x-ray film cassette comprises a vertical member which is sized to allow the film to be completely immersed in chemistry solution when the cover plate is disposed in the lowered position. Attached to the vertical member are a plurality of paired horizontally extending arms which are sized to contact and hold the x-ray film after exposure and during development. The arms preferably are grooved on their inner surfaces to facilitate the frictional holding of the film, and labeled with indicia to facilitate the maintenance of order and orientation of the film. A name plate is also preferably attached to the cassette to facilitate patient identification.

In the preferred embodiment, the front walls of the reaction chamber are oriented in a manner complimentary to the shape of the x-ray film cassette and/or larger x-ray film rack. Additionally, the distance separating the front and back walls (i.e., the width of the side walls) is dimensioned so as to slightly exceed the width of the plate member. Advantageously, the x-ray film cassette and larger film rack are configured to be attachable to the inner surface of the cover plate when the cover plate is in the raised position. In this respect, the upper part of the cassette and rack are attached to the inner surface of the cover plate in a manner wherein the x-ray film resides completely within the reaction chamber when the cover plate is disposed in the lowered position, and will be totally immersed in the chemistry solutions sequentially applied to the reaction chamber. In operation of the developer system of the present invention, the technician exposes radiographs on the patient in a given predetermined order. The exposed radiographs are placed in the cassette in that same given order (which is pre-labeled by the manufacturer), which cassette may be advantageously positioned upon the wall rack located in the x-ray operatory. The radiographs are then transferred to the darkroom where the radiographs are uncovered and replaced in the same groove or notch in the cassette, maintaining order and orientation. The cassette (or rack, in the case of larger x-ray film) is subsequently positioned or mounted to the inner surface of the cover member. The cover plate is subsequently actuated to its lowered position so as to cover the reaction chamber. The valve disposed between the first reservoir and reaction chamber is then opened to allow a quantity of the developer agent to flow from the first reservoir into the reaction chamber via the first feed line to contact and substantially engulf the x-ray film. The flow of developer solution stops automatically when the liquid level of the "filling" reaction tank equals the level of liquid in the "emptying" developer reservoir (see FIG. 6). After a sufficient period of time, the vacuum motor is activated so as to remove the developer from the reaction chamber and deposit the same back into the first reservoir via atmospheric pressure differential. While atmospheric pressure differential created by the vacuum motor holds the developer fluid in the developer tank, the valve is closed.

After the developer cycle, the valve disposed between the second reservoir and reaction chamber is opened to allow the fixative agent to fill the reaction chamber. Similarly, flow of fixative stops automatically when the liquid level of the reaction chamber and fixer reservoir are at the same level (see FIG. 6). After a sufficient period of time, the vacuum motor is again activated to pull, via reduced atmospheric pressure, the fixative agent out of the reaction chamber and back into the second reservoir. Again, while the fixative liquid is held in the second reservoir by the vacuum motor, the second valve is closed. Subsequently, a wash cycle is conducted via water filling the reaction tank from the water valve covering and washing the x-ray film. After the wash cycle, the drain valve is opened, draining the water out of the reaction tank. In view of the x-ray film being maintained static throughout the developing cycle, damage to the same is eliminated. Further, since the only moving parts of the system comprise the vacuum motor and valves, maintenance on the present developer is substantially reduced over the prior art automated conveyor systems. In this regard, it will be recognized that the present invention utilizes a gravity flow filling cycle for the reaction chamber and a pressure differential emptying cycle for the reaction chamber, wherein by operation of the vacuum motor, reduced pressure in the reservoirs draws solution from the reaction chamber while atmospheric pressure (14.7 lbs/sq. in.) existing in the reaction chamber pushes the solutions from the reaction chamber back into the reservoirs. Further, the solutions never are in contact with any pump as in the prior art.

BRIEF DESCRIPTION OF THE DRAWINGS

These as well as other features of the present invention will become more apparent upon reference to the drawings wherein:

FIG. 7 is a perspective view of the wall holder of the present invention having the x-ray film cassette depending therefrom;

FIG. 8 is a perspective view of the large film holder or rack of the present invention; and FIG. 9 is a schematic diagram of the control circuitry of the present invention.

DETAILED DESCRIPTION OF THE PREFERRED EMBODIMENT

Figure 1:
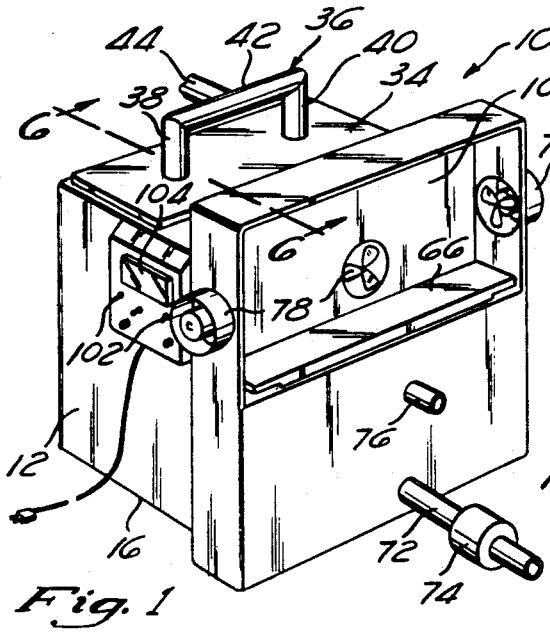
FIG. 1 is a front perspective view of the automated dental x-ray developer of the present invention.

Referring now to the drawings wherein the showings are for purposes of illustrating a preferred embodiment of the present invention only and not for purposes of limiting the same, FIG. 1 perspectively illustrates the automated dental x-ray developer 10 constructed in accordance with the preferred embodiment of the present invention. Referring to FIGS. 1, 2, and 4–6, developer 10 generally comprises a housing 12 having a large, generally rectangular basin 14 disposed therein defining a bottom surface 16, front surface 18, back surface 20, and side surfaces 22. The front surface 18, back surface 20, and side surfaces 22 are of substantially uniform height thereby providing the rectangular basin 14 with a substantially uniform peripheral upper edge 24. Extending perpendicularly upward from the bottom surface 16 is a septum 26 which extends between the front surface 18 and back surface 20 and includes a top edge 28 terminating at the upper edge 24. As such, septum 26 serves to substantially bisect rectangular basin 14 thereby defining a first reservoir 30 and a second reservoir 32 therewithin which are substantially equal in size and volume.

Figure 5:
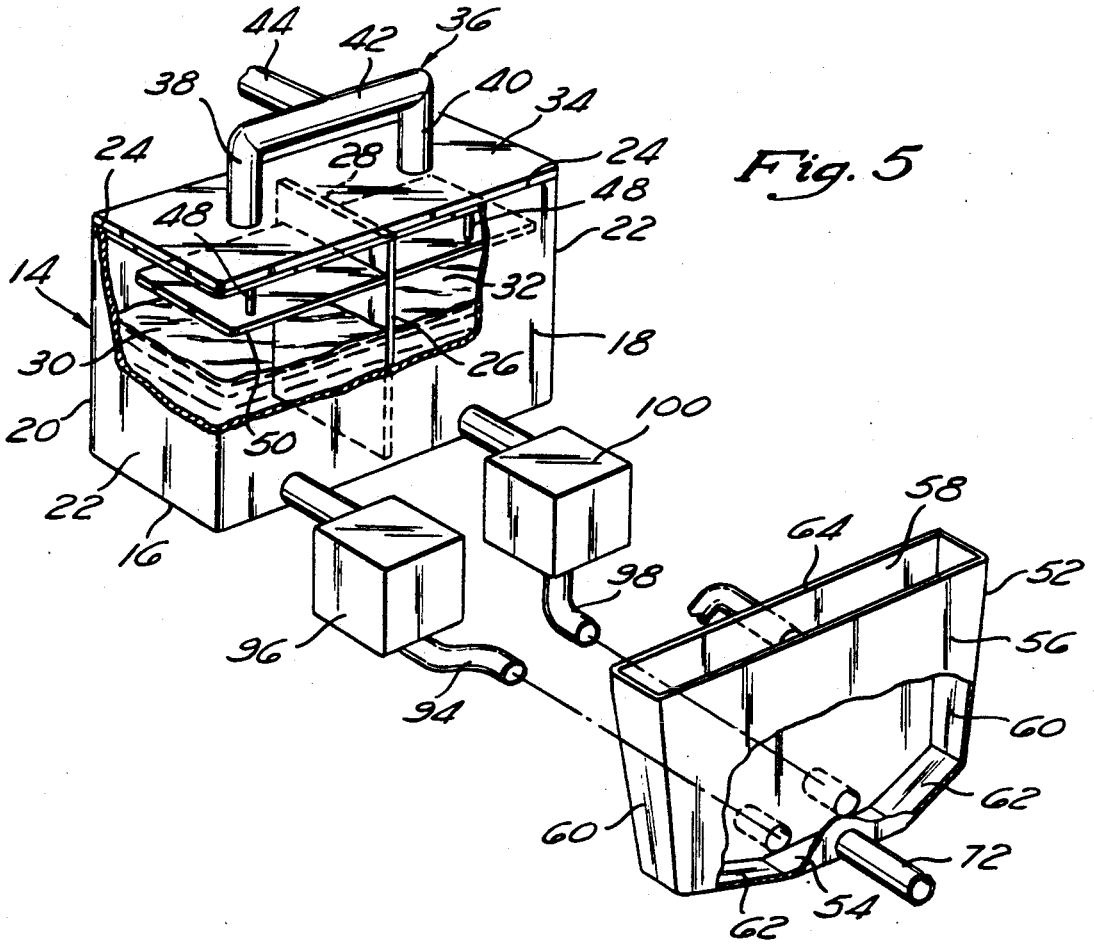
FIG. 5 is an exploded view of the present invention.
Figure 6:
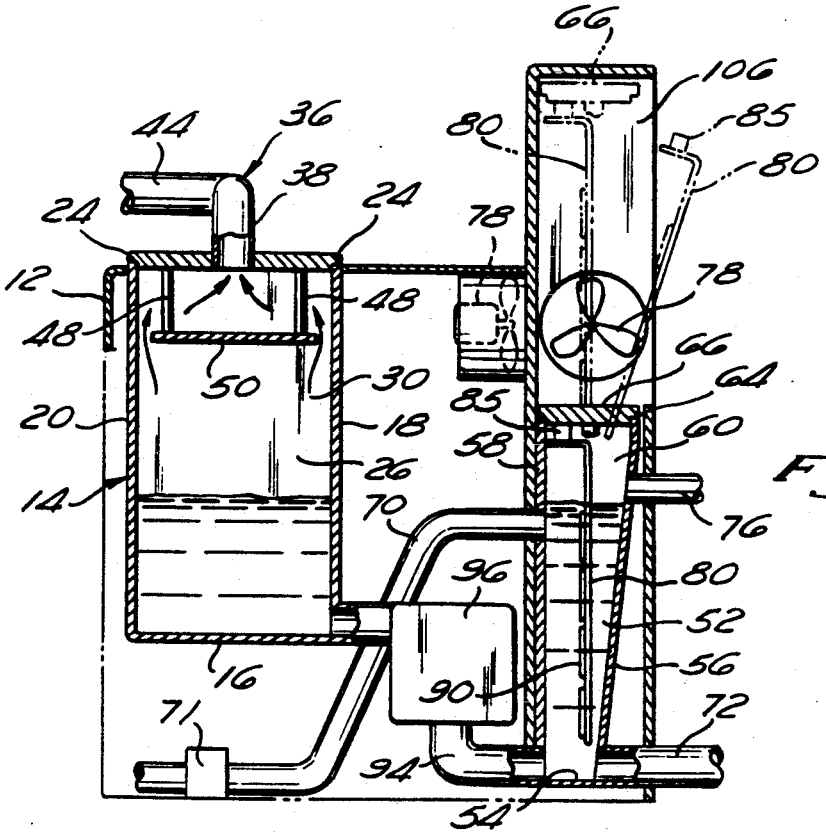
FIG. 6 is a cross-sectional view of the present invention taken about line 6—6 of FIG. 1.

In the preferred embodiment, first reservoir 30 is sized to store a quantity of a developer agent or solution therein, while second reservoir 32 is sized to store a quantity of a fixative agent or solution therein. Releasably attached to the rectangular basin 14, and more particularly the upper edge 24 thereof, is a lid member 34. Additionally, attached to the outer surface of lid member 34 is a manifold 36. As best seen in FIGS. 5 and 6, manifold 36 includes a first portion 38 which is in fluid communication with the interior of basin 14 at a location over the center of first reservoir 30 when lid member 34 is attached to upper edge 24. Manifold 36 further includes a second portion 40 which is in fluid communication with the interior of basin 14 at a location over the center of second reservoir 32 when lid member 34 is attached to upper edge 24. First portion 38 and second portion 40 are connected via a tubular center portion 42 having a third portion 44 extending perpendicularly therefrom. Additionally, coupled to the distal end of third portion 44 is a vacuum motor 45 (shown schematically in FIG. 7). As will be recognized, due to the configuration of manifold 36, when the vacuum motor 45 is activated, air is drawn from within basin 14, i.e., the first reservoir 30 and second reservoir 32, via first portion 38 and second portion 40, reducing air pressure existing within the reservoirs 30 and 32. As best seen in FIGS. 5 and 6, attached to the inner surface of lid member 34 via a plurality of posts 48 is a fluid baffle plate 50. The use of the baffle plate 50 and operation of the vacuum motor 45 will be explained in greater detail below.

In the preferred embodiment, also disposed within housing 12 is a reaction chamber 52 defining a lower surface 54, front wall 56, back wall 58, and side walls 60. Extending between the lower surface 54 and side walls 60 are upwardly inclined intermediate walls 62. Importantly, the front wall 56, back wall 58, and side walls 60 are of substantially uniform height thereby defining a continuous peripheral upper rim 64. As best seen in FIG. 6, the bottom surface 16 of rectangular basin 14, and hence the bottom surfaces of first reservoir 30 and second reservoir 32, is preferably positioned at an elevation above the lower surface 54 of reaction chamber 52 to facilitate gravity flow of fluid from each reservoir 30 and 32 into the reaction chamber 52 as will be more fully discussed below.

Figure 2:
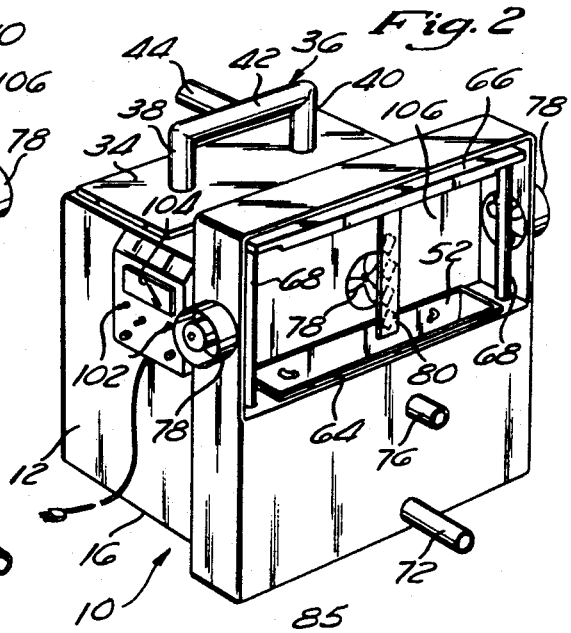
FIG. 2 is a front perspective view illustrating the cover member of the housing in a raised (into the dryer cabinet) orientation and including the x-ray film cassette attached to the inner surface thereof.
Figure 3A:
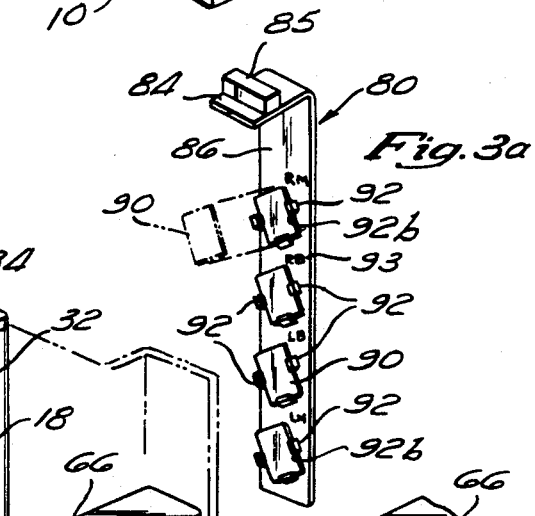
FIG. 3*a* is a front perspective view of the x-ray film cassette illustrating the manner in which multiple pieces of x-ray film are attached thereto.
Figure 4:
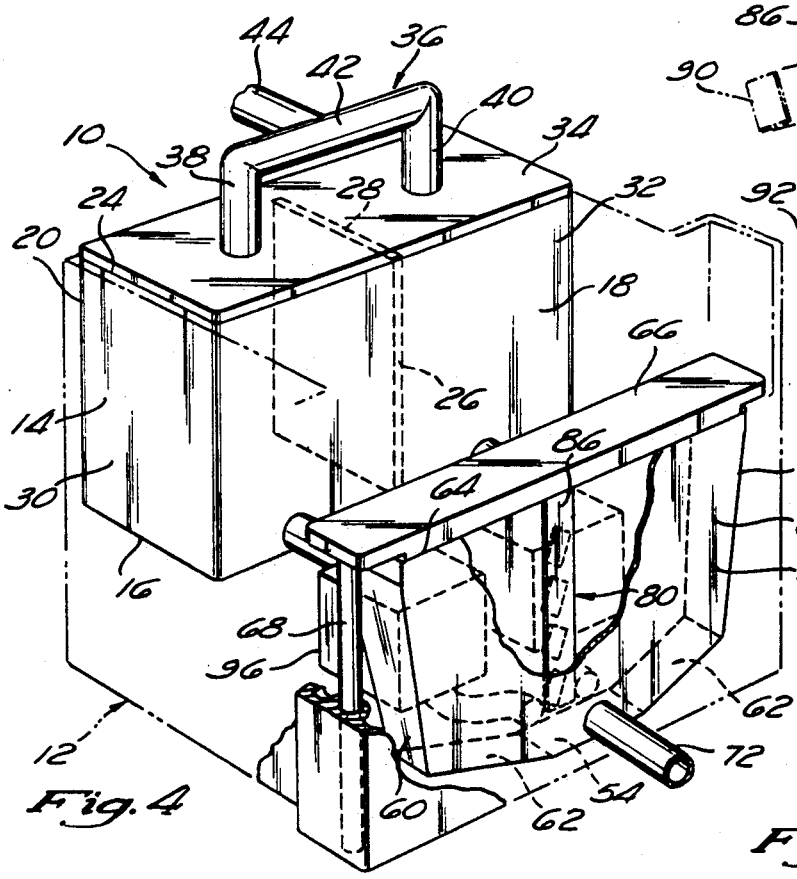
FIG. 4 is a front perspective view of the present invention illustrating the x-ray cassette and other internal components disposed within the housing.

Referring now to FIGS. 1, 2, and 4, slidably interfaced to housing 12 is a cover plate 66. Importantly, cover plate 66 is interfaced to the housing 12 in a manner wherein the cover plate 66 is selectively positionable upon the upper rim 64 of reaction chamber 52. Extending downwardly from the opposed ends of cover plate 66 are first and second cylindrical posts 68, which are slidably received into complimentary-shaped recesses formed within the housing 12. As such, cover plate 66 is reciprocally removable between a raised position (shown in FIG. 2) wherein the inner surface thereof is separated from the upper rim 64 and a lowered position (shown in FIG. 1) wherein the inner surface thereof is in abutting contact with the upper rim 64 of reaction chamber 52. In the preferred embodiment, the cover plate 66 is actuated between the raised and lowered positions by a cover lift linear actuator/motor 69 (shown in FIG. 9) which is interfaced to the posts 68 for automatically raising and lowering the cover plate 66.

Referring now to FIGS. 5 and 6, fluidly coupled to reaction chamber 52 adjacent the upper rim 64 thereof is a water filler line 70, which is connected to an incoming water source via a water valve 71. The filler line 70 is adapted to selectively flow water within the interior of the reaction chamber 52 for reasons which will be discussed below. Also fluidly coupled to and extending from the reaction chamber 52 is a drain line 72 which is interfaced to the front or back wall 56 of the reaction chamber 52 at a point adjacent the lower surface 54 thereof. As seen in FIG. 1, coupled with the drain line 72 is a drain valve 74, the use of which will be explained below. The reaction chamber 52 further includes an overflow line 76 (shown in FIG. 6) fluidly coupled to the reaction chamber adjacent the upper rim 64. The frontal upper portion of the housing defines a dryer cabinet 106 which is located above the reaction chamber to surround the cover member 66 and film cassette when the cover member 66 is disposed in its raised position. One or more heat fans 78 are mounted to the dryer cabinet 106 and are used to selectively cause heat and air to be circulated within the interior of dryer cabinet 106 as will be discussed below.

Referring now to FIG. 7, attachable to the outer wall of the x-ray operatory room is a wall holder 82 with an attachment plate **82*a* with an identical type of attachment device present on the underside of the cover plate 66 of the automatic developer as described herebelow. The attachment plate 82*a* holds the x-ray cassette 80 while the radiographs are being exposed, and allows the technician to conveniently place the exposed films in said cassette 80 in proper order and orientation. Attached vertically to the attachment plate is a wall plate 83** utilized in mounting the wall holder to the operatory external wall.

Referring now to FIGS. **3*a* and 3*b*, selectively attachable to and removable from the under surface of cover member 66 and the wall holder 82 is an x-ray film cassette 80. As can be appreciated, the film cassette 80 is attachable to the under surface of cover member 66 when the cover member is in the raised position and is sized and configured so as to completely reside within the reaction chamber when the cover member is actuated to the lowered position. The cassette is composed of a vertical member 86 and horizontal holding plate 84 which facilitates the attachment of the cassette and film to the attachment plate 82*a* of the wall holder 82 and the plate member 66 of the automatic developer. The holding plate 84 is preferably provided with a magnet member 85 which magnetically latches the cassette to the cover member and/or wall holder 82. To the vertical member 86 of the cassette 80 are attached a plurality of pairs of horizontal arms 92 which have paired grooves or notches 92*b* which are sized and spaced to frictionally hold the x-ray films in place after exposure of the film and during the developing procedure. Preferably the horizontal arms 92 and/or vertical member 86 will include indicia 93 forming labels thereon. Exemplary labels (shown in FIG. 7) are RB (right bicuspids) and LM (left molars). The labels will allow the technician to place the exposed film in the proper grooves 92*b*** so that order and orientation are maintained throughout developing procedures.

As will be recognized, the structure of the film cassette 80 maintains the organization of the x-ray film 90 by maintaining the integrity of the set of film inserted into the recesses or grooves of the plate member 82. As such, the likelihood of one patient's x-rays being mixed in with those of another is substantially eliminated. Further, the cassette is labeled so that the order and orientation of the exposed radiographs is maintained from exposure in the patient's mouth through the mounting of developed film. In addition to maintaining the integrity of the set, the structure of the film cassette 80 further aids in maintaining the x-ray series in proper order. So that mounting of films on x-ray mounts can be accomplished without actually viewing the x-ray picture. In this regard, the radiographs are exposed, they are mounted in specific order and orientation in the cassette, which is held by the wall holder 82. Though in the preferred embodiment only one film cassette 80 is depicted attached to the inner surface of cover member 66, it is noted that the inner surface is configured to allow up to five or six film cassettes 80 to be attached thereto, thus allowing for the simultaneous developing of multiple sets of x-rays, all of which are maintained in proper identity, order, and orientation. A tag is additionally preferably included on the cassette on which the patient's name may be written by the x-ray technician to prevent mix-up of patient's films.

Referring now to FIG. 8, as an alternative to the cassette 80, attachable to the inner surface of cover member 66 and the attachment plate 82*a* of the wall holder 82 is a large film rack 107. As can be appreciated, the large film rack 107 is attachable to the under surface of cover member 66 when the cover member is in the raised position and is sized and configured so as to completely reside within the reaction chamber when the cover member is actuated to the lowered position. The rack is composed of a vertical member 108 which include plural small clips 111 which allow the holding of large film 110 to the rack, and a horizontal member 109 which facilitates the attachment of the large film rack 107 and large film 110 to the attachment plate 82*a* of the wall holder 82 and the plate member 66 of the automatic developer via magnets 113. The large film rack 107 allows for the development of larger film, such as panographic dental film, and medical film, such as chest x-ray film.

Referring now to FIGS. 5 and 6, connecting the first reservoir 30 to the reaction chamber 52 is a first feed line 94 which extends between a point adjacent bottom surface 16 to a point adjacent lower surface 54. Coupled within first feed line 94 is a first valve 96 which is used to selectively place the reaction chamber 52 in fluid communication with the developer agent stored within first reservoir 30. Connecting the second reservoir 32 to the reaction chamber 52 is a second feed line 98 which also extends between a point adjacent the bottom surface 16 to a point adjacent the lower surface 54. Coupled within the second feed line 98 is a second valve 100 which is used to selectively place the reaction chamber 52 in fluid communication with the fixative agent stored within second reservoir 32.

Referring now to FIG. 9, the developer 10 constructed in accordance with the present invention further includes a control means 101. The control means 101 preferably comprises a timer controller module 103 disposed within the housing 12 which is connected to a power source 105 and is activated via switches 102 disposed on the exterior of the housing 12, with its operation being monitored by a display 104 also included on the housing 12 (shown in FIG. 1). The timer controller 103 is used to effectuate a desired timed sequence of events and thus is operable to cause the developer 10 to sequentially move through a number of cycles. It will be recognized that the timing between the various cycles may be modified through the adjustment of the timer controller 103. Having thus described the components comprising the developer 10, the various cycles initiated by the timer controller 103 will now be described.

Figure 3B:
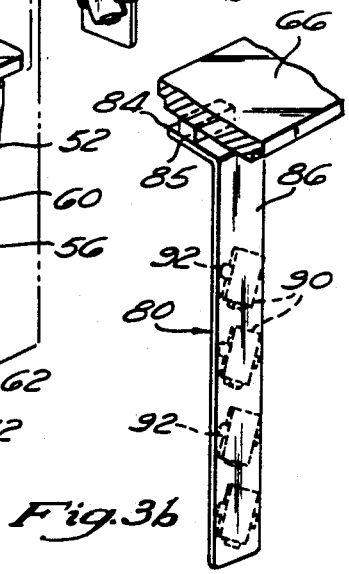
FIG. 3*b* is a perspective view of the x-ray film cassette rotated 90 degrees from FIG. 3*a* and illustrating its orientation when mounted to the cover member.

When utilizing the developer 10 of the present invention, the cover plate 66 is initially power actuated to the raised position (shown in FIG. 2) and the x-ray film cassette or large film rack 80 having the x-ray film inserted therein is attached to the inner surface of the cover member 66 The cassette 80 is preferably positioned in the orientation shown in FIG. 3*b* with the x-ray films being disposed or facing toward the rear wall of the reaction chamber. Thereafter, the developer is switched on utilizing one of the switches disposed on the housing, which causes the cover plate to be actuated to the lowered position (shown in FIG. 1) such that the film cassette 80 resides within the reaction chamber 52, which starts the developer cycle.

The timer controller 103 subsequently initiates a first cycle wherein the timer controller 103 opens the first valve 96 while simultaneously maintaining the second valve 100 and drain valve 74 in a closed position. When the first valve 96 is opened, the reaction chamber 52 fills via gravity flow with the developer agent from the first reservoir 30 via the first feed line 94. As previously specified, the bottom surfaces of both the first and second reservoirs 30, 32 are positioned at an elevation above the lower surface 54 of the reaction chamber 52. Importantly, the elevation of the first reservoir 30, the volume of the developer agent stored therewithin, and the internal volume of the reaction chamber 52 are specifically sized such that when the first valve 96 is opened, the reaction chamber 52 will fill via gravity to a level engulfing the x-ray film 90. Particularly, the reaction chamber 52 fills to a level completely covering the x-ray film 90 in the film cassette 80 but not rising to a level substantially thereabove. The influx of developer into the reaction chamber ceases when the level of the liquid rising in that chamber equals that in the emptying reservoir, utilizing the law that liquid seeks its own level. As previously specified, the internal configuration of the reaction chamber 52 is specifically adapted to require a minimal volume of the developer agent to engulf x-ray film cassette 80 and thus allows for a lesser volume of the developer agent to be initially stored within the first reservoir 30 to achieve the aforementioned filling effect.

After the x-ray film 90 has been immersed within the developer agent for a fixed amount of time, the timer controller 103 initiates a second cycle wherein the timer controller 103 activates the vacuum motor 45 to draw the developer agent from within the reaction chamber 52 back into the first reservoir 30 via the first feed line 94 and first valve 96. In this respect, the reduced air pressure created by the vacuum in the first reservoir and the attendant push of atmospheric pressure on the solution in the reaction tank causes the developer agent to re-enter the first reservoir 30. As the developer agent is pulled back into the first reservoir 30, oftentimes splashing occurs. As such, the baffle plate 50 is provided within the rectangular basin 14 to prevent any of the developer agent from being pulled into the manifold 36 and hence into the vacuum motor 45. Additionally, since the baffle plate 50 is positioned between the reservoirs 30, 32 and ports 38, 40, the baffle plate 50 serves to cause the vacuum to be pulled uniformly within basin 14. After all of the developer agent has been returned into the first reservoir 30 by pressure differential, the timer controller 103 initiates a third cycle wherein the timer controller 103 closes the first valve 96 and deactivates the vacuum motor.

Thereafter, the timer controller 103 initiates a fourth cycle wherein the timer controller 103 opens the second valve 100 while simultaneously maintaining the first valve 96 and drain valve 74 in a closed position. The opening of the second valve 100 allows the reaction chamber to fill with the fixative agent stored within the second reservoir 32 via the second feed line 98. As previously noted, the influx of fluid into the reaction chamber is halted when the levels in the reaction chamber and the fix reservoir are equal, due to the fact that liquid seeks its own level. As will be recognized, the filling of the reaction chamber 52 with the fixative agent from the second reservoir 32 will occur in the same manner previously described with respect to the developer agent.

After the x-ray film 90 has been immersed within the fixative agent for a preset period of time, the timer controller 103 initiates a fifth cycle wherein the timer controller 103 activates the vacuum motor 45 to draw the fixative agent from the reaction chamber 52 back into the second reservoir 32 via atmospheric pressure differential through the second feed line 98 and second valve 100. Once again, the splashing of the fixative agent into the motor 45 is prevented by the baffle plate 50.

After all the fixative agent has been drawn back into the second reservoir 32, the timer controller 103 initiates a sixth cycle wherein the timer controller 103 closes the second valve 100 and deactivates the vacuum motor 45. Thereafter, the timer controller 103 initiates a seventh cycle wherein the timer controller 103 opens water valve 71, thus activating the water fill line 70 for a timed period, allowing the reaction tank to fill with fresh water, which will rinse remnant chemistry from the film, cassette, or rack and tank walls.

The water valve remains on until the reaction tank is filled, then is automatically shut off by a liquid level switch 46. After a given period, all the water flowed into the reaction chamber 52 by the water fill line 70 during the rinsing operation is drained via the drain line 72 and actuation of drain valve 74 to an external drain system.

It will be recognized that if during the filling of the reaction chamber 52 with either the developer or fixative agents, or during the rinse cycles, the fluid level within the reaction chamber 52 exceeds a predetermined maximum, the overflow line 76 will prevent the agents or water from overflowing the reaction chamber.

After the rinse cycle has been completed, the timer controller 103 initiates an eighth cycle wherein the drain valve 74 closes, readying itself for future cycles; the cover plate 66 raises, lifting the wet and fully developed x-ray film 90 into the dryer cabinet 106; and the heat-fans 78 activate drying the radiographs. Once dried, x-ray film cassette or rack 80 is then removed from the inner surface of the cover plate (as illustrated by the phantom lines in FIG. 6), with the x-ray film 90 being subsequently removed from within the recesses therein in a fully developed state. The film is then mounted easily into the x-ray mounts without the need to view the "pictures" because order and orientation have been maintained from the patient's mouth to the cassette to the developer, and finally to the x-ray mount. The x-ray film must simply be removed from the cassette 80 and placed in the mounts. Advantageously, in view of the x-ray film 90 being maintained static throughout the developing cycle, damage to the same is eliminated. Further, since the only moving parts of the developer 10 comprise the vacuum motor 45, first and second valves 96, 100, drain valve 74, and water valve 71, maintenance on the developer 10 will be substantially reduced over the prior art automated conveyor systems.

Additional modifications and improvements of the present invention may also be apparent to those skilled in the art. Thus, the particular combination of parts described and illustrated herein is intended to represent only one embodiment of the invention and is not intended to serve as limitations of alternative devices within the spirit and scope of the invention.

What is claimed is:

1. An automated dental x-ray developer, comprising a first reservoir for storing a quantity of a developer agent, said first reservoir defining a first bottom surface;

a second reservoir for storing a quantity of a fixative agent, said second reservoir defining a second bottom surface;

a reaction chamber sized and configured to receive at least one x-ray film mount, said reaction chamber defining a cover, front and back walls, an upper rim, and a lower surface, said first and second bottom surfaces being positioned at an elevation above said lower surface;

at least one vacuum motor fluidly coupled to said first and second reservoirs;

a first feed line connecting said first reservoir to said reaction chamber, said first feed line extending between a point adjacent said first bottom surface to a point adjacent said lower surface and including a first valve coupled therein for selectively placing said reaction chamber in fluid communication with the developer agent stored within said first reservoir;

a second feed line connecting said second reservoir to said reaction chamber, said second feed line extending between a point adjacent said second bottom surface to a point adjacent said lower surface and including a second valve coupled therein for selectively placing said reaction chamber in fluid communication with the fixative agent stored within said second reservoir;

at least one water filler connected to a water source via a water valve and fluidly coupled to said reaction chamber;

at least one drain line fluidly coupled to and extending from said reaction chamber, said drain line including a drain valve coupled therein for selectively opening and closing said drain line; and a control means operable to cause said developer to sequentially move through:

a first cycle wherein said control means opens said first valve while simultaneously maintaining said second valve and said drain valve in a closed position thereby allowing said reaction chamber to fill via gravitational flow with said developer agent via said first feed line to a level substantially engulfing said x-ray film, said gravitational flow of fluid terminating when the liquid level in the reaction chamber equalizes with the liquid level in the first reservoir;

a second cycle wherein said control means activates said vacuum motor to draw the developer agent from the reaction chamber via atmospheric pressure differential back into the first reservoir through the first feed line and first valve;

a third cycle wherein said control means closes the first valve and deactivates the vacuum motor;

a fourth cycle wherein said control means opens said second valve while simultaneously maintaining said first valve and said drain valve in a closed position thereby allowing said reaction chamber to fill via gravitational flow with said fixative agent via said second feed line to a level substantially engulfing said x-ray film, said gravitational flow of fluid being stopped when the liquid level in the reaction chamber equalizes with the liquid level in the second reservoir;

a fifth cycle wherein said control means activates said vacuum motor to draw the fixative agent from the reaction chamber back into the second reservoir via the second feed line and second valve through the use of atmospheric pressure differential;

a seventh cycle wherein said control means opens the water valve to activate the water filler filling the reaction chamber with water, thereby allowing said x-ray film to be rinsed with water to remove residual chemistry therefrom, the water being subsequently drained from the reaction chamber via activation of the drain line; and an eighth cycle wherein the control means closes the drain valve, raises the reaction tank cover and x-rays, and starts a heater-fan commencing the drying of the radiographs.

2. The device of claim 1 further comprising an overflow line fluidly coupled to said reaction chamber adjacent said upper rim.

3. The device of claim 1 further comprising a dryer cabinet, with said heater-fan being disposed in said dryer cabinet.

4. The device of claim 1 wherein said reaction chamber cover comprises a cover plate selectively attachable to said upper rim of said reaction chamber, said cover plate having an inner surface and an outer surface and being movable between a raised position whereat said cover member is separated from said upper rim and a lowered position whereat said cover member is in abutting contact with said upper rim.

5. The device of claim 4 wherein said x-ray film mount comprises a cassette attachable to said inner surface of said cover plate when said cover plate is in said raised position, said film cassette being sized, configured, and attachable to said inner surface in a manner wherein said film cassette resides completely within said reaction chamber when said cover plate is in said lowered position.

6. The device of claim 5 wherein said X-ray film cassette comprises:

a vertical member;

a plurality of horizontal arms attached to said vertical member;

a plurality of recesses formed in vertical registry along said horizontal arms, each of said recesses being sized and configured to receive a piece of X-ray film;

a series of labels for maintaining the X-ray film in a desired order and orientation in the cassette throughout developing procedures; and a name tag for identifying a patient.

7. The device of claim 4 wherein said X-ray film mount comprises a large X-ray film rack attachable to said inner surface of said cover plate when said cover plate is in said raised position, said film rack being sized, configured, and attachable to said inner surface in a manner wherein said film rack resides completely within said reaction chamber when said cover plate is in said lowered position.

8. The device of claim 1 further in combination with a wall holder having a wall plate mountable to an external operatory wall and an attachment plate which facilitates holding in place said X-ray film mount upon said operatory wall.

9. The device of claim 7 wherein said film rack comprises:

a pair of vertical members;

a horizontal member extending between said vertical members; and a plurality of clips attached to said vertical members and said horizontal member for holding a piece of X-ray film during developing procedures.

* * * * *